United States Patent [19]

Werner

[11] 4,091,873

[45] May 30, 1978

[54] FIRE EXTINGUISHANT DISPENSING NOZZLES

[76] Inventor: Clements M. Werner, 4246 S. Whitnall Ave., Milwaukee, Wis. 53207

[21] Appl. No.: 840,858

[22] Filed: Oct. 11, 1977

Related U.S. Application Data

[62] Division of Ser. No. 769,425, Feb. 17, 1977.

[51] Int. Cl.[2] ..... A62C 35/34

[52] U.S. Cl. ..... 169/37; 239/490; 239/500; 239/504

[58] Field of Search ..... 169/37; 239/222.17, 239/490, 498, 500, 501, 504

[56] References Cited

U.S. PATENT DOCUMENTS

| | | | |
|---|---|---|---|
| 2,005,600 | 6/1935 | Tappen | 239/500 |
| 3,768,736 | 10/1973 | Cox | 169/37 |

*Primary Examiner*—Robert W. Saifer
*Attorney, Agent, or Firm*—Jenkins, Coffey & Hyland

[57] ABSTRACT

Upright and pendent sprinklers for attachment to a supply of fire extinguishant each include a nozzle defining an opening for directing a stream of extinguishant, a deflector for deflecting a portion of the stream generally radially outwardly from the axis of the nozzle opening, and a framework or yoke for supporting the deflector in fixed spaced-apart relation to the nozzle. In the upright sprinkler, a second deflector is provided for deflecting a second portion of the stream generally downwardly concentric with the axis of the nozzle opening. The second deflector includes a downwardly facing concave surface bounded by an outer downwardly directed discharging lip. The second deflector is located intermediate the nozzle and the first-mentioned deflector. The second deflector also includes an inner directing lip defining a proportioning aperture for passing a fixed part of the stream upwardly to the first mentioned deflector and for directing a second portion of the stream upwardly, radially outwardly and then downwardly along the concave surface to the discharging lip. The pendent sprinkler includes a second aperture provided in the yoke beneath the first-mentioned aperture, and at least one vane which projects into the second aperture. The vane creates turbulence in the portion of the stream passed by the first aperture as it passes through the second aperture.

7 Claims, 5 Drawing Figures

FIRE EXTINGUISHANT DISPENSING NOZZLES

This is a division of application Ser. No. 769,425 filed Feb. 17, 1977.

This invention relates to discharge sprinklers for fire extinguishant systems and more particularly, to such sprinklers wherein a plurality of deflectors are provided for discharging extinguishant in two separate, generally coaxial discharge patterns. One of the disclosed sprinklers is for upright applications, and the other is for pendent applications.

There are many known types of fire extinguishant distribution sprinklers, both of the pendent type and of the upright type. Examples of such fire extinguishant distribution apparatus include the devices illustrated in the following United States Patents: Schmidt, U.S. Pat. No. 885,869; Moore, U.S. Pat. No. 1,727,111; DeFlon, U.S. Pat. No. 2,375,528; Rider, U.S. Pat. No. 2,724,614; Mac Innes et al, U.S. Pat. No. 3,061,204; Livingston, U.S. Pat. No. 3,779,318; and, Todetenkopf, U.S. Pat. No. 3,802,512.

The sprinklers of the present invention provide improved distribution patterns for fire extinguishant, e.g. water, wherein fire extinguishant is directed toward the base of the fire to attack and saturate the source of fuel for the fire. In addition, the sprinklers of the present invention direct fire extinguishant sprays generally horizontally below the ceiling in an area to cool the area above the flames by generating a steam fog and depleting the oxygen source for the flames, and eventually saturating the space with enough water spray to contain the fire.

In the pendent sprinkler of the instant invention, at least one vane is provided in an aperture at the bottom of the supporting frame or yoke to direct a turbulent spray over an area at the base of the flame. The action of the vane, when added to the effect of an intermediate deflector plate of the type described in, for example the above-identified U.S. Pat. No. 3,802,512 reduces the intensity of the flames, to reduce the amount of extinguishant used and douse the fire more quickly. Reduction of the amount of extinguishant used reduces the potential for damage by the extinguishant to the contents of the room or building involved.

The upright sprinkler of the instant invention includes a second deflector between the sprinkler nozzle and the conventional upper or first deflector. The second deflector comprises a downwardly facing concave surface bounded by an outer, downwardly directed discharging lip. The second deflector deflects a portion of the stream projected upwardly from the nozzle generally downwardly concentrically with the axis of the nozzle. The second deflector includes an inner directing lip defining a proportioning aperture for passing a fixed portion of the stream upward to the first-mentioned deflector, and for directing a second portion of the stream upwardly, radially outwardly and then downwardly along the concave surface to the discharging lip where the water is discharged in a generally cylindrical pattern toward the base of the fire.

The pendent sprinkler includes a downwardly opening nozzle for generating a stream of extinguishant, a deflector for diverting a portion of the stream radially outwardly from the axis of the nozzle, and means for supporting the deflector in fixed, spaced-apart relation beneath the nozzle for passing a portion of the stream. Means are provided for defining a second aperture beneath the first-mentioned aperture. At least one vane creates a turbulent spray in the portion of the stream passed through the first aperture. The vane projects into the second aperture. The second aperture and vane cooperate to produce a generally cylindrical downwardly directed stream of extinguishant toward the base of the fire.

In the upright sprinkler, second deflectors having apertures of different cross-sectional areas can be substituted to vary the relative proportions of extinguishant passed for distribution generally horizontally adjacent the ceiling and directed downwardly in a generally cylindrical pattern onto the base of the fire. A smaller proportioning aperture will result in more extinguishant being directed downwardly toward the base of the fire. In the pendent sprinkler, the sizes of the first and second apertures can be varied to proportion the relative amounts of extinguishant directed radially outwardly from the nozzle axis and axially downwardly toward the base of the fire. Increasing the area of these apertures results in more extinguishant being directed downwardly onto the base of the fire.

The invention may best be understood by referring to the following description and accompanying drawings which illustrate the invention.

Figure 1:
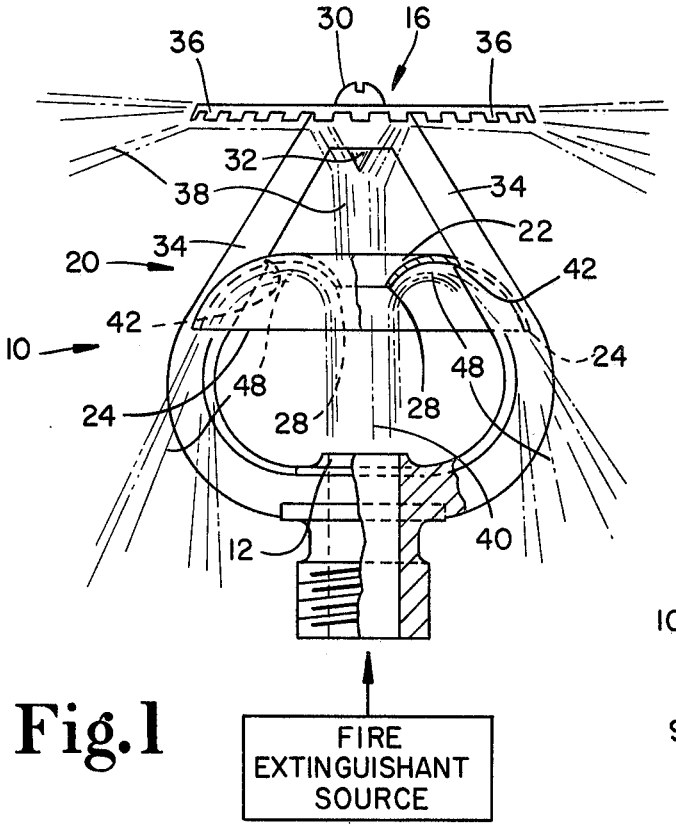
FIG. 1 is a side elevational view, partly cut away, of an upright sprinkler constructed in accordance with the present invention.

Referring now to FIG. 1, the construction and operation of the upright sprinkler will be explained. The upright sprinkler 10 includes a nozzle 12 to which is connected a source of fire extinguishant, illustrated diagrammatically. Sprinkler 10 includes a deflector 16 mounted upon a supporting frame or yoke 20, and a second deflector 22 comprising a downwardly facing concave surface having a radially outer, downwardly directed discharging lip 24 and radially inner stream splitting or directing lip 28.

The first-mentioned deflector 16 is attached by a screw 30 having a diffuser point 32 at the junction of the two arms 34 of the yoke 20. The deflector 16 is generally circular, and has a serrated edge 36. The serrations of edge 36 are angled downwardly to break up into a fine mist the portion 38 of the water stream 40 which is deflected into an annular pattern by deflector 16.

Figure 2:
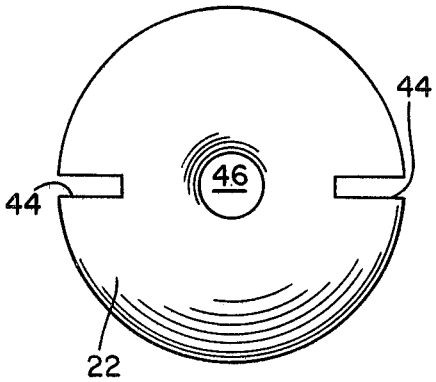
FIG. 2 is a top plan view of a detail of the sprinkler of FIG. 1.

Arms 34 of the yoke are both notched, as at 42 to receive and support the second deflector 22. As FIG. 2 best illustrates, deflector 22 includes slots 44 which are directed radially inwardly from discharging lip 24 to receive arms 34 to a sufficient depth that deflector 22 rests in notches 42. The fit of the deflector between arms 34 can be a press fit or deflector 22 can be welded, soldered or otherwise substantially permanently attached to arms 34. Second deflector 22 can be replaced by a deflector having a different diameter center aperture 46 defined by directing lip 28. A different diameter aperture results in different proportions of stream 40 being directed upwardly and outwardly by lip 28. Lip 28 preferrably has a knife edge to split the stream of extinguishant precisely.

As extinguishant stream 40 issues upwardly from nozzle 12, the stream is split into a radially inner portion 38 which passes through aperture 46 and a radially outer stream portion 48 which is deflected upwardly, radially outwardly and then downwardly concentric with the axis of nozzle 12 by the deflector 22. This stream portion 48 forms a generally coaxial and radially inner column of water with stream portion 38 which is deflected from deflector 16. Stream portion 48 is provided to attack the base of the fire, lowering the temperature of the fuel and saturating the area adjacent the fire. Stream portion 38 provides a coaxial and substantally broader extinguishant pattern to cool and dissipate hot gases evolved by the fire and to reduce temperatures in a somewhat wider area than stream portion 48. By reducing the temperature in a wider vicinity of the fire, stream portion 38 can prevent other similar sprinklers adjacent the fire area from opening needlessly, thereby preventing needless water damage.

Figure 4:
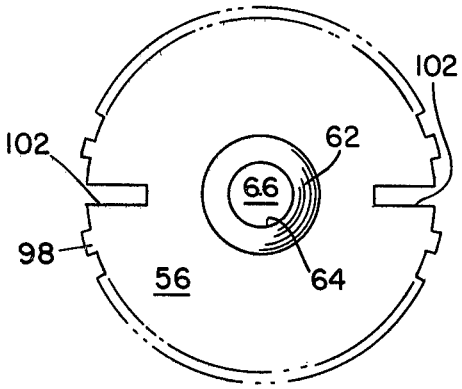
FIG. 4 is a top plan view of a detail of the sprinkler of FIG. 3.
Figure 5:
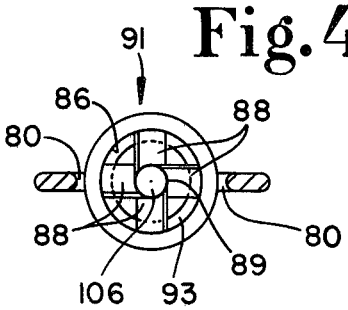
FIG. 5 is a partial sectional view of the sprinkler of FIG. 3 taken along section lines 5—5 thereof.
Figure 3:
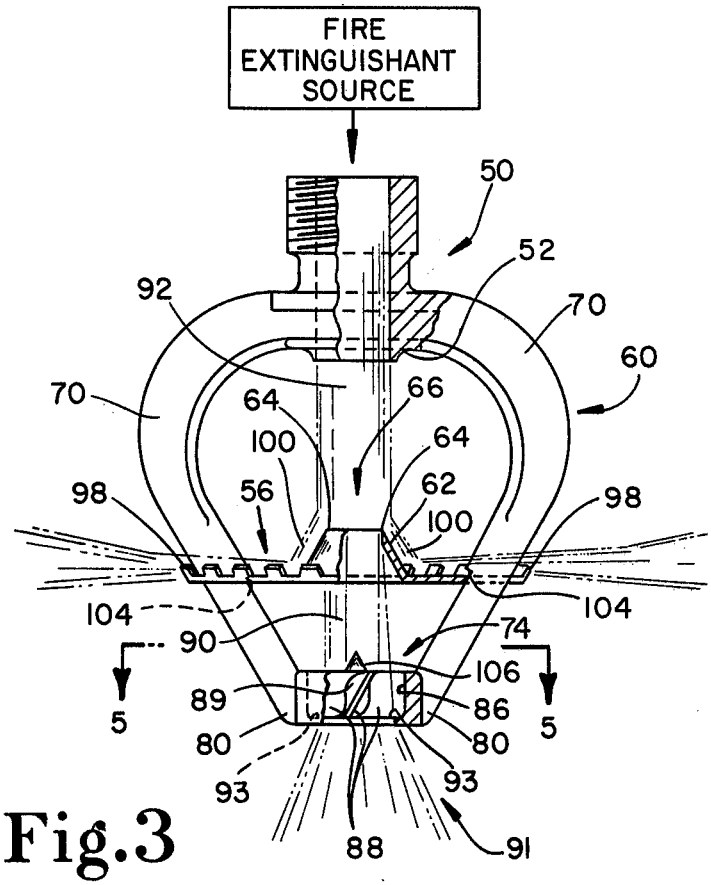
FIG. 3 is a side elevational view, partly cut away, of a pendent sprinkler constructed in accordance with the present invention.

The pendent sprinkler 50 of FIGS. 3–5 includes a nozzle 52 which is connected to an extinguishant source, illustrated diagrammatically in FIG. 3. A deflector 56 is situated directly beneath nozzle 52 and is supported by yoke 60. Deflector 56 includes a diffusing cone 62 which extends upwardly from the top surface of the deflector. Diffusing cone 62 terminates at a stream splitting or directing lip 64. Lip 64 defines a first aperture 66 through deflector 56. Lip 64 preferrably has a knife edge to split the stream of extinguishant precisely.

The arms 70 of yoke 60 extend downwardly to form a second aperture 74 at their distal ends 80. Aperture 74 is ring-shaped and includes an inner cylindrical wall 86. Four vanes 88 protrude into aperture 74 from wall 86 at right angles to one another. Vanes 88 are joined at a center shaft 89 to form an assembly 91. The vane assembly 91 rests on a peripheral ledge 93 provided therefor at the bottom of aperture 74. Vanes 88 are pitched to impart turbulence to the portion 90 of extinguishant stream 92 which passes through aperture 66 from nozzle 52. Vanes 88 can be replaced by another set of vanes having a different pitch to vary the turbulence of the spray generated in aperture 74.

The first deflector 56 includes a serrated radially outer edge 98 which breaks up the portion 100 of the extinguishant stream 92 which is directed radially outwardly from lip 64 by cone 62. As in the embodiment of FIGS. 1–2, slots 102 (FIG. 4) are provided in deflector 56. Slots 102 extend radially inwardly from edge 98 and cooperating stop notches 104 are provided in arms 70. Deflector 56 can be attached to yoke 60 so that it may be replaced by a different deflector having a different diameter proportioning aperture 66 to vary the relative portions 90, 100 of extinguishant stream 92.

A small diffuser cone 106 is provided at the junction of vanes 88 to separate stream 90 somewhat before it encounters vanes 88. As with the enbodiment of FIGS. 1–2, stream portion 90 will be directed toward the base of the fire to saturate and cool the fuel which is feeding the fire. Stream portion 100 provides an outer generally concentric extinguishant spray pattern to cool and dissipate hot gases generated by the fire. Again, this broad spray pattern helps to prevent needless opening of adjacent sprinklers and extinguishant damage which can attend opening of such adjacent sprinklers.

It is understood that conventional fusable thermal elements or release devices of the type illustrated in the aforementioned U.S. Pat. No. 3,802,512 can be used in conjunction with the extinguishant sprinklers of the instant invention. Since such release devices are of conventional construction, however, no reference has been made to them in this description.

What is claimed is:

1. In a pendent sprinkler for producing a downwardly directed spray of fire extinguishant, the sprinkler comprising a downwardly opening nozzle for generating a stream of extinguishant, a deflector for diverting a portion of the stream outwardly and means for supporting the deflector in fixed, spaced-apart relation beneath the nozzle opening, the deflector including means beneath the nozzle defining an aperture for passing a portion of the stream, the improvement comprising means for providing a second aperture beneath the first-mentioned aperture, and means for creating turbulence in the portion of the stream passed by the first aperture as it passes through the second aperture, the turbulence generating means being disposed to project into the second aperture.

2. The apparatus of claim 1 wherein the turbulence generating means comprises at least one vane projecting into the second aperture from a sidewall thereof.

3. The apparatus of claim 2 wherein there are four vanes disposed approximately 90° apart about and beneath the diffusing cone and extending radially inwardly from the wall of the second aperture toward the center thereof.

4. The apparatus of claim 2 and further comprising a diffusing cone located intermediate the first and second apertures to diffuse the undiverted portion of the stream before the undiverted portion passes over the vanes.

5. The apparatus of claim 2 wherein a plurality of vanes is joined to a common center to form a vane assembly.

6. The apparatus of claim 5 wherein the common center is generally concentric with the second aperture.

7. The apparatus of claim 5 wherein the means for providing a second aperture includes means for providing a ledge for supporting the vane assembly.

* * * * *